US010377972B2

(12) United States Patent
Oehms et al.

(10) Patent No.: US 10,377,972 B2
(45) Date of Patent: Aug. 13, 2019

(54) DETERGENT COMPOSITION

(71) Applicant: Reckitt Benckiser Finish B.V., Hoofddorp (NL)

(72) Inventors: Diana Oehms, Ludwigshafen (DE); Pavlinka Roy, Ludwigshafen (DE); Ralf Wiedemann, Mira (IT)

(73) Assignee: RECKITT BENCKISER FINISH B.V., Hoofddorp (NL)

( * ) Notice: Subject to any disclaimer, the term of this patent is extended or adjusted under 35 U.S.C. 154(b) by 0 days.

(21) Appl. No.: 15/361,857

(22) Filed: Nov. 28, 2016

(65) Prior Publication Data

US 2017/0283745 A1 Oct. 5, 2017

Related U.S. Application Data

(63) Continuation of application No. 12/679,567, filed as application No. PCT/GB2008/003274 on Sep. 26, 2008, now abandoned.

(30) Foreign Application Priority Data

Sep. 28, 2007 (GB) ..... 0718944.2

(51) Int. Cl.

| | |
|---|---|
| ***C11D 17/00*** | (2006.01) |
| ***C11D 11/00*** | (2006.01) |
| ***C11D 3/386*** | (2006.01) |
| ***C11D 3/39*** | (2006.01) |
| ***C11D 3/33*** | (2006.01) |
| ***C11D 17/04*** | (2006.01) |

(52) U.S. Cl.

CPC ..... *C11D 3/386* (2013.01); *C11D 3/33* (2013.01); *C11D 3/3942* (2013.01); *C11D 3/3945* (2013.01); *C11D 17/003* (2013.01); *C11D 17/0078* (2013.01); *C11D 17/042* (2013.01)

(58) Field of Classification Search

None

See application file for complete search history.

(56) References Cited

U.S. PATENT DOCUMENTS

| | | | |
|---|---|---|---|
| 5,994,290 A | 11/1999 | Potthoff-Karl et al. | |
| 6,194,368 B1 | 2/2001 | Waschenbach et al. | |
| 6,368,420 B1 | 4/2002 | Angevaare et al. | |
| 6,486,117 B1 | 11/2002 | Painter et al. | |
| 2002/0019325 A1 | 2/2002 | Olsen | |
| 2003/0050206 A1 | 3/2003 | Waschenbach et al. | |
| 2003/0176307 A1 | 9/2003 | Housmekerides et al. | |
| 2004/0053808 A1 | 3/2004 | Raehse et al. | |
| 2005/0020469 A1 | 1/2005 | Rahse et al. | |
| 2005/0119154 A1* | 6/2005 | Song | C11D 3/0073 510/508 |
| 2005/0261155 A1 | 11/2005 | Wiedemann et al. | |
| 2006/0042662 A1 | 3/2006 | Geret et al. | |
| 2006/0243630 A1 | 11/2006 | Bourgoin et al. | |
| 2007/0054828 A1 | 3/2007 | Gentschev et al. | |
| 2007/0167343 A1 | 7/2007 | Suzuki et al. | |
| 2008/0113893 A1 | 5/2008 | Rowland et al. | |
| 2010/0139695 A1 | 6/2010 | Wiedemann et al. | |

FOREIGN PATENT DOCUMENTS

| | | |
|---|---|---|
| DE | 1942236 | 3/1971 |
| DE | 4009532 A1 | 9/1991 |
| EP | 0481547 A1 | 4/1992 |
| EP | 0973855 A1 | 9/1998 |
| EP | 0976820 A1 | 2/2000 |
| EP | 1239029 A1 | 9/2002 |
| EP | 1443098 A2 | 8/2004 |
| EP | 1721962 A1 | 11/2006 |
| GB | 2311536 A | 10/1997 |
| WO | 9839406 A1 | 9/1998 |
| WO | 0134759 A1 | 5/2001 |
| WO | 2007025666 A1 | 3/2007 |
| WO | 2007025944 A1 | 3/2007 |
| WO | 2008087417 A1 | 7/2008 |
| WO | 2008087420 A1 | 7/2008 |

OTHER PUBLICATIONS

Erster Band, "Amin", Brockhaus Enzyklopadie, p. 498, 1986, F.A. Brockhaus GmbH, Mannheim, Germany.

* cited by examiner

*Primary Examiner* — Lorna M Douyon

(74) *Attorney, Agent, or Firm* — Troutman Sanders LLP; Ryan Schneider; Chris Davis

(57) ABSTRACT

A detergent composition comprising an enzyme and a bleaching compound and comprising two or more distinct regions, wherein the enzyme is located in a first distinct region and the bleaching compound is located in a second distinct region and further wherein a builder comprising an amino acid based compound and/or succinate based compound is located in the first distinct region. The compositions exhibit improved stability of the enzyme.

11 Claims, No Drawings

DETERGENT COMPOSITION

CROSS-REFERENCE TO RELATED APPLICATIONS

This application is a Continuation of and claims priority to U.S. patent application Ser. No. 12/679,567, filed on 12 Jul. 2010, now abandoned, which is a U.S. National Stage Entry of International Application No. PCT/GB2008/003274, filed on 26 Sep. 2008, which claims the benefit of GB 0718944.2, filed on 28 Sep. 2007, all of which are herein fully incorporated by reference as if set forth below.

BACKGROUND OF THE INVENTION

Technical Field

The present invention relates to detergent compositions comprising an enzyme and a bleaching compound. In particular the present invention relates to such a detergent composition wherein the bleaching compound and the enzyme are located in different regions of the composition.

Background

It is well known that detergent compositions comprising both an enzyme and a bleaching compound typically suffer from stability problems of the enzyme because of the detrimental effect thereon of the bleaching compound. This results in either 1) loss of performance of the enzyme and hence the detergent compound, and/or 2) the need to include increased levels of the enzyme in the detergent composition so increasing cost.

It has been attempted to address the above problem by separating the bleaching compound and the enzyme into different regions in order to reduce the possibility that the bleach will adversely affect the stability of the enzyme and products of this type are already commercially available.

Simply separating these ingredients into different regions has not been found to sufficiently address the instability problem of the enzyme as some reaction still takes place between the bleaching compound and the enzyme at the interface of the regions and thus stability of the detergent compositions and/or performance may still desirably be improved.

DE-A-4009532 discloses a cleaning composition formed from two detergent pastes. One paste comprises the enzyme, zeolite A builder and other bleach sensitive ingredients and the other paste comprises perborate monohydrate builder.

EP-A-976820 discloses three layered tablets wherein the external layers comprise the enzyme system and the central layer comprises a bleaching system. The layer comprising the enzyme system may also comprise a builder.

Despite the above, there is still a need to improve enzyme stability in detergent compositions comprising an enzyme, a bleaching compound and certain organic builders.

It is an object of the present invention to address one or more of the above-mentioned problems. In particular, it is an object of the present invention to provide detergent compositions exhibiting good enzyme stability. It is a further object of the present invention to provide detergent compositions exhibiting good performance. It is still a further object of the present invention to provide detergent compositions exhibiting good enzyme stability and performance.

BRIEF SUMMARY OF THE INVENTION

As specified in the Background Section, there is a great need in the art to identify technologies for detergent compositions and use this understanding to develop novel detergent compositions exhibiting good enzyme stability and/or good performance. The present invention satisfies this and other needs. Embodiments of the present invention relate generally to providing good enzyme stability or good performance and more specifically to providing both good enzyme stability and good performance.

In one aspect, the invention provides a detergent composition comprising an enzyme and a bleaching compound and comprising two or more distinct regions, wherein the enzyme is located in a first distinct region and the bleaching compound is located in a second distinct region and further wherein a builder comprising an amino acid based compound and/or succinate based compound is located in the first distinct region.

In one embodiment, the enzyme comprises a protease.

In another embodiment, the amino acid based compound comprises methyl-glycine-diacetic acid, and salts and derivatives thereof and/or glutamic-N,N-diacetic acid and salts and derivatives thereof and/or iminodisuccinic acid and alkali metal salts or ammonium salts thereof and/or (hydroxy)iminodisuccinic acid and alkali metal salts or ammonium salts thereof.

In yet another embodiment, the bleaching compound is selected from inorganic peroxides or organic peracids and their derivatives and mixtures thereof.

In one embodiment of the invention, the bleaching compound is selected from the group consisting of inorganic peroxides, percarbonates, perborates and persulphates and their salts.

In another embodiment, the first distinct region comprises 10% wt or less of the total amount of bleaching compound in the detergent composition.

In some embodiments, the first distinct region is substantially free of bleaching compound, preferably free of bleaching compound.

In still another embodiment, the second distinct region comprises 10% wt or less of the total amount of enzyme in the detergent composition.

In some embodiments, the second distinct region is substantially free of enzyme, preferably free of enzyme.

In one embodiment, the composition is an automatic dishwashing composition.

In another embodiment, the composition is in the form of a shaped body.

Another aspect of the invention provides the use of a detergent composition as described herein, including a detergent composition comprising an enzyme and a bleaching compound and comprising two or more distinct regions, in a cleaning operation.

Yet another aspect of the invention provides a process of cleaning soiled items by contacting the soiled items with a detergent composition as described herein, including a detergent composition comprising an enzyme and a bleaching compound and comprising two or more distinct regions.

These and other objects, features and advantages of the present invention will become more apparent upon reading the following specification in conjunction with the accompanying description and claims.

DETAILED DESCRIPTION OF THE INVENTION

As specified in the Background Section, there is a great need in the art to identify technologies for detergent compositions and use this understanding to develop novel detergent compositions exhibiting good enzyme stability and/or good performance. The present invention satisfies this and other needs. Embodiments of the present invention relate generally to providing good enzyme stability or good performance and more specifically to providing both good enzyme stability and good performance.

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or examples. The invention is capable of other embodiments and of being practiced or carried out in various ways. Also, in describing the exemplary embodiments, specific terminology will be resorted to for the sake of clarity.

Definitions

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named. In other words, the terms "a," "an," and "the" do not denote a limitation of quantity, but rather denote the presence of "at least one" of the referenced item.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value. Further, the term "about" means within an acceptable error range for the particular value as determined by one of ordinary skill in the art, which will depend in part on how the value is measured or determined, i.e., the limitations of the measurement system. For example, "about" can mean within an acceptable standard deviation, per the practice in the art. Alternatively, "about" can mean a range of up to ±20%, preferably up to ±10%, more preferably up to ±5%, and more preferably still up to ±1% of a given value. Alternatively, particularly with respect to biological systems or processes, the term can mean within an order of magnitude, preferably within 2-fold, of a value. Where particular values are described in the application and claims, unless otherwise stated, the term "about" is implicit and in this context means within an acceptable error range for the particular value.

Unless stated otherwise, all amounts herein are given as the percentage by weight of active ingredient based upon the weight of the total composition.

The term "distinct region" as used herein means a region either having a different composition to the adjacent region(s) or which is formed in a separate operation to the adjacent region(s).

The term "substantially free of" as used herein means less than 0.5% wt of the material in question based on the total weight of that material in the detergent composition.

The terms "succinate based compound" and "succinic acid based compound" are used interchangeably herein.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

Throughout this description, various components may be identified having specific values or parameters, however, these items are provided as exemplary embodiments. Indeed, the exemplary embodiments do not limit the various aspects and concepts of the present invention as many comparable parameters, sizes, ranges, and/or values may be implemented. The terms "first," "second," and the like, "primary," "secondary," and the like, do not denote any order, quantity, or importance, but rather are used to distinguish one element from another.

It is noted that terms like "specifically," "preferably," "typically," "generally," and "often" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention. It is also noted that terms like "substantially" and "about" are utilized herein to represent the inherent degree of uncertainty that may be attributed to any quantitative comparison, value, measurement, or other representation.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "50 mm" is intended to mean "about 50 mm."

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described hereinafter as making up the various elements of the present invention are intended to be illustrative and not restrictive. Many suitable materials that would perform the same or a similar function as the materials described herein are intended to be embraced within the scope of the invention. Such other materials not described herein can include, but are not limited to, materials that are developed after the time of the development of the invention, for example. Any dimensions listed in the various drawings are for illustrative purposes only and are not intended to be limiting. Other dimensions and proportions are contemplated and intended to be included within the scope of the invention.

Embodiments of the Invention

It has surprisingly been found that the enzyme stability and/or performance in a detergent composition comprising a bleaching compound and enzyme in different regions of the composition can be further improved when the region comprising the enzyme further comprises certain other ingredients.

Thus according to the present invention there is provided a detergent composition comprising an enzyme and a bleaching compound and comprising two or more distinct regions, wherein the enzyme is located in a first distinct region and the bleaching compound is located in a second distinct region and further wherein a builder comprising an amino acid based compound and/or succinate based compound is located in the first distinct region.

Preferably the enzyme comprises a protease.

It is preferred that the builder located in the first distinct region comprises an amino acid based compound and/or succinate based compound, most preferably methyl-glycine-diacetic acid, and salts and derivatives thereof and/or (glutamic-N,N-diacetic acid and salts and derivatives thereof and/or iminodisuccinic acid and alkali metal salts or ammonium salts thereof and/or (hydroxy)iminodisuccinic acid (HIDS) and alkali metal salts or ammonium salts thereof.

It is preferred that the bleaching compound is selected from inorganic peroxides or organic peracids and their derivatives and mixtures thereof, and in particular that it is selected from inorganic peroxides are percarbonates, perborates and persulphates and their salts.

It is preferred that the first distinct region comprises 10% wt or less of the total amount of bleaching compound in the detergent composition and most preferably is substantially free of bleaching compound and in particular is free of bleaching compound.

It is preferred that the second distinct region comprises 10% wt or less of the total amount of enzyme in the detergent composition, most preferably is substantially free of enzyme and in particular is free of enzyme.

It is especially preferred that the detergent composition according to the invention is a dishwashing composition and in particular an automatic dishwashing composition.

It is preferred that the composition is in the form of a shaped body.

According to a second embodiment there is provided the use of a detergent composition of the first aspect in a cleaning operation.

According to a third embodiment there is provided a process of cleaning soiled items by contacting the soiled items with a detergent composition of the first aspect.

Surprisingly, it has been found that compositions according to the invention exhibit improved enzyme stability and/or performance compared to the stability/performance achieved by simply separating the bleaching compound and the enzyme.

Compositions of the Invention

The present invention will now be described in further detail.

A) Types of Detergent Compositions

The detergent compositions of the invention may be used in principle for any cleaning operation. However, it is preferred that the detergent compositions are laundry detergents or hard surface cleaning compositions for example dishwashing detergents, floor cleaners or surface cleaners. It is most preferred that the hard surface cleaning compositions are dishwashing compositions and in particular automatic dishwashing compositions.

The detergent composition may be used to clean soft surfaces such as fabrics and upholstery material and hard surfaces such as crockery, cutlery and household surfaces.

B) Detergent Composition Format

The detergent compositions of the present invention may be of any suitable form which allows the composition to comprise two or more distinct regions. Typically the detergent composition will be in the form of a shaped body such as a tablet, rod, ball or lozenge. It is possible that the composition may comprise a paste or gel region(s), provided that distinct regions of the composition may still be provided.

According to the present invention, it is preferred that at least one distinct region of the tablet is solid (e.g. compressed powder, cast, injection moulded or extruded material), preferably at least two distinct regions. It is most preferred that no more than two regions are gel phases and depending upon the format of the composition it may be preferred that a single phase is a gel.

According to one embodiment of the invention, all of the distinct regions of the detergent composition are solid. According to another embodiment, the detergent composition comprises two or more solid distinct regions and one or two gel or paste phases. When the detergent composition comprises both solid and gel/paste phases, any suitable arrangement of these phases may be used as desired. These phases (regions) may be separated by water-soluble barrier means or film, e.g., made from water soluble polymers such as polyvinyl alcohol if desired. One especially preferred embodiment is a multi chambered water soluble body, preferably a substantially rigid body, comprising at least one solid (e.g. particulate) composition and at least one liquid or gel composition.

For many applications, e.g., an automatic dishwashing product, the detergent composition is preferably in the form of a unit dose product, i.e., a form which is designed to be used as a single portion of detergent composition in a washing operation. Of course, one or more of such single portions may be used in a cleaning operation.

The composition may be encased in a water soluble wrapping, for, example of polyvinyl alcohol (PVOH) or a cellulosic material.

If such a wrapping is used, the detergent composition is preferably substantially surrounded thereby, most preferably totally surrounded thereby.

C) Distinct Regions of the Detergent Composition

The detergent compositions of the invention comprise two or more distinct regions. The compositions may comprise three distinct regions and four or five distinct regions may be suitable for some applications.

The distinct regions of the composition will generally be of differing formulations. However, two or more distinct regions may have the same, or very similar, formulations if desired provided that the requirements for the location of the enzyme, bleaching compound and builder according to the invention are met.

The distinct regions may be adhered/joined together by any suitable means, e.g., by compression the regions together, providing interlocking portions or by using a material which acts to adhere the regions together. Any suitable material may be used as an adhesive material between two or more distinct regions.

D) Enzyme

The detergent compositions of the invention comprise an enzyme in a first region. Minor amounts of an (or the) enzyme may be located in one or more further distinct regions of the detergent composition in addition to the first distinct region, but it is preferred that the second region (which comprises the bleaching compound) comprises 10% wt or less of the total amount of enzyme in the detergent composition, or even 5% wt or less. Most preferably, the second region is substantially free of enzyme and it is especially preferred that it is free of enzyme.

Desirably, the enzyme is present in the compositions in an amount of from 0.01 to 3 wt %, especially 0.01 to 2 wt %, for each type of enzyme when added as a commercial preparation. As they are not 100% active preparations, this represents an equivalent amount of 0.005 to 1 wt % of pure enzyme, preferably 0.01 to 0.75 wt %, especially 0.01 to 0.5% wt of each enzyme used in the compositions. The total amount of enzyme in the detergent composition is preferably in the range of from 0.01 to 6 wt %, especially 0.01 to 3 wt %, which represents an equivalent amount of 0.01 to 2 wt % of pure enzyme, preferably 0.02 to 1.5 wt %, especially 0.02 to 1% wt of total enzyme used in the compositions.

Any type of enzyme conventionally used in detergent compositions may be used according to the present invention. It is preferred that the enzyme is selected from proteases, lipases, amylases, cellulases and peroxidases, with proteases and amylases, especially proteases being most preferred. It is most preferred that protease and/or amylase enzymes are included in the compositions according to the invention; such enzymes are especially effective for example in dishwashing detergent compositions. Any suitable species of these enzymes may be used as desired.

When a distinct region comprising the enzyme is a solid, it may be produced by any suitable means, e.g., by pressing (compacting) of a particulate material, extrusion, casting or injection moulding. However, according to one embodiment of the present invention, it is especially preferred that this region is produced by pressing. This has the advantage that the process can be carried out at approximately room temperature and at temperatures up to about 40° C., which is beneficial for the stability of the enzymes as elevated temperatures which may be used in the other processes may be detrimental to enzyme stability.

E) Bleaching Compound

The detergent compositions of the invention comprise a bleaching compound in the second distinct region. Minor amounts of the bleaching compound may be located in one or more further distinct regions of the detergent composition in addition to the second distinct region, but it is preferred that the first region (which comprises the enzyme) comprises 10% wt or less of the total amount of bleaching compound in the detergent composition, or even 5% wt or less. Most preferably, the first region is substantially free of bleaching compound and it is especially preferred that it is free of bleaching compound.

Any type of bleaching compound conventionally used in detergent compositions may be used according to the present invention. Preferably, the bleaching compound is selected from inorganic peroxides or organic peracids, derivatives thereof (including their salts) and mixtures thereof. Especially preferred inorganic peroxides are percarbonates, perborates and persulphates with their sodium and potassium salts being most preferred. Sodium percarbonate and sodium perborate are most preferred, especially sodium percarbonate.

Organic peracids include all organic peracids traditionally used as bleaches, including, for example, perbenzoic acid and peroxycarboxylic acids such as mono- or diperoxyphthalic acid, 2-octyldiperoxysuccinic acid, diperoxydodecanedicarboxylic acid, diperoxy-azelaic acid and imidoperoxycarboxylic acid and, optionally, the salts thereof. Especially preferred is phthalimidoperhexanoic acid (PAP).

Desirably, the bleaching compound is present in the compositions in an amount of from 1 to 30 wt %, especially 5 to 25 wt %, most preferably 10 to 20% wt.

F) Builder

The detergent compositions of the invention comprise a builder comprising an amino acid based compound and/or succinate based compound in the first distinct region. Minor amounts of the builder or a builder may be located in one or more further distinct regions of the detergent composition in addition to the first distinct region, but it is preferred that the second region (which comprises the bleaching compound) comprises 10% wt or less of the total amount of builder in the detergent composition, or even 5% wt or less. Most preferably, the second region is substantially free of builder and it is especially preferred that it is free of builder.

Conventional amounts of the amino acid based compound and/or succinate based compound may be used in the detergent compositions.

Preferred examples of amino acid based compounds according to the invention are MGDA (methyl-glycine-diacetic acid, and salts and derivatives thereof) and GLDA (glutamic-N,N-diacetic acid and salts and derivatives thereof). GLDA (salts and derivatives thereof) is especially preferred according to the invention, with the tetrasodium salt thereof being especially preferred. Other suitable builders are described in U.S. Pat. No. 6,426,229 which is incorporated by reference herein. Particularly suitable builders include, for example, aspartic acid-N-monoacetic acid (ASMA), aspartic acid-N,N-diacetic acid (ASDA), aspartic acid-N-monopropionic acid (ASMP), iminodisuccinic acid (IDA), N-(2-sulfomethyl) aspartic acid (SMAS), N-(2-sulfoethyl)aspartic acid (SEAS), N-(2-sulfomethyl)glutamic acid (SMGL), N-(2-sulfoethyl)glutamic acid (SEGL), N-methyliminodiacetic acid (MIDA), α-alanine-N,N-diacetic acid (α-ALDA), β-alanine-N,N-diacetic acid (β-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N, N-diacetic acid (TUDA) and sulfomethyl-N,N-diacetic acid (SMDA) and alkali metal salts or ammonium salts thereof.

Further preferred succinate compounds are described in U.S. Pat. No. 5,977,053 and have the formula:

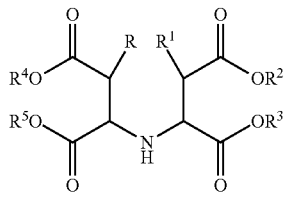

in which:

R, $R^1$, independently of one another, denote H or OH;

$R^2$, $R^3$, $R^4$, $R^5$, independently of one another, denote a cation, hydrogen, alkali metal ions and ammonium ions, ammonium ions having the general formula $R^6$ $R^7$ $R^8$ $R^9$ N+; and $R^6$, $R^7$, $R^8$, $R^9$, independently of one another, denoting hydrogen, alkyl radicals having 1 to 12 C atoms or hydroxyl-substituted alkyl radicals having 2 to 3 C atoms.

A preferred example is tetrasodium iminosuccinate. Iminodisuccinic acid (IDS) and (hydroxy)iminodisuccinic acid (HIDS) and alkali metal salts or ammonium salts thereof are especially preferred succinate based builder salts.

Preferably the first distinct region comprises MGDA and/or GLDA and/or IDS and/or HIDS as builder.

In addition to the amino acid based compound and/or succinate based compound, additional builders may also be present, and these may be either phosphorous based or non-phosphorous based, or even a combination of both types. Suitable builders are well known in the art.

If phosphorous builders are also to be used in the detergent compositions of the inventions, then it is preferred that mono-phosphates, di-phosphates, tri-polyphosphates or oligomeric-polyphosphates are used. The alkali metal salts of these compounds are preferred, in particular the sodium salts. An especially preferred builder is sodium tripolyphosphate (STPP).

If additional builders to the amino acid based compound and/or succinate based compound are used, it is preferred that these are non-phosphorous builders.

The non-phosphorous based additional builders may be organic molecules with carboxylic group(s). Builder compounds which are organic molecules containing carboxylic groups include citric acid, fumaric acid, tartaric acid, maleic acid, lactic acid and salts thereof. In particular the alkali or alkaline earth metal salts of these organic compounds may be used, and especially the sodium salts. An especially preferred builder is sodium citrate.

Preferably the total amount of builder present in the compositions is an amount of at least 5 wt %, preferably at least 10 wt %, more preferably at least 20 wt %, and most preferably at least 25 wt %, preferably in an amount of up to 70 wt %, preferably up to 65 wt %, more preferably up to 60 wt %, and most preferably up to 35 wt % based on the total weight of the composition. The actual amount used in the compositions will depend upon the nature of the builder used. It is especially preferred that an amino acid based builder is used in an amount of 20 wt % to 65 wt % as above.

The detergent compositions of the invention may further comprise a secondary builder (or cobuilder). This is preferably also located in the first distinct region. Preferred secondary builders include homopolymers and copolymers of polycarboxylic acids and their partially or completely neutralized salts, monomeric polycarboxylic acids and hydroxycarboxylic acids and their salts, phosphates and phosphonates, and mixtures of such substances. Preferred salts of the abovementioned compounds are the ammonium and/or alkali metal salts, i.e. the lithium, sodium, and potassium salts, and particularly preferred salts is the sodium salts. Secondary builders which are organic are preferred.

Suitable polycarboxylic acids are acyclic, alicyclic, heterocyclic and aromatic carboxylic acids, in which case they contain at least two carboxyl groups which are in each case separated from one another by, preferably, no more than two carbon atoms.

Polycarboxylates which comprise two carboxyl groups include, for example, water-soluble salts of, malonic acid, (ethylenedioxy)diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid.

Another suitable polycarboxylic acid is the homopolymer of acrylic acid. Other suitable builders are disclosed in WO 1995/001416, to the contents of which express reference is hereby made.

Preferably the total amount of co-builder present in the compositions is an amount of up to 10 wt %, preferably at least 5 wt %. The actual amount used in the compositions will depend upon the nature of the builder used. The distinct regions may contain any proportion of the total amount of co-builder as desired.

G) Optional Ingredients

The compositions of the invention may further comprise one or more of the following optional ingredients in any one or more of the different regions of the detergent composition. The amount of any of the optional ingredients typically present in each distinct region of the detergent compositions will depend upon the % wt of the total amount of that ingredient desired to be included in that distinct region and the total amount to desired be used in the detergent composition. The typical amounts to be included in the different distinct regions can be calculated from the information given herein.

The detergent compositions preferably comprise one or more bleach activators. Any suitable bleach activator may be included for example TAED. Conventional amounts may be used, e.g., in amounts of from 0.01 to 10 wt %, more preferred of from 0.1 to 8 wt % and most preferred of from 0.5 to 5 wt % based on the weight of the total composition.

The bleach activator may be located in any distinct region of the detergent compositions, but it is preferred that it is predominantly located in a region other than that in which the bleaching compound is predominantly located.

The detergent compositions of the invention may contain surface active agents, for example, anionic, cationic, amphoteric or zwitterionic surface active agents or mixtures thereof. Many such suitable surfactants are described in Kirk Othmer's Encyclopedia of Chemical Technology, 3rd Ed., Vol. 22, pp. 360-379, "Surfactants and Detersive Systems", incorporated by reference herein. In general, bleach-stable surfactants are preferred for use in at least the region(s) comprising the bleaching material.

A preferred class of nonionic surfactants are ethoxylated non-ionic surfactants prepared by the reaction of a monohydroxy alkanol or alkylphenol with 6 to 20 carbon atoms. Preferably the surfactants have at least 12 moles particularly preferred at least 16 moles, and still more preferred at least 20 moles, such as at least 25 moles of ethylene oxide per mole of alcohol or alkylphenol.

Particularly preferred non-ionic surfactants are the non-ionics from a linear chain fatty alcohol with 16-20 carbon atoms and at least 12 moles, particularly preferred at least 16 and still more preferred at least 20 moles, of ethylene oxide per mole of alcohol.

According to one embodiment of the invention, the non-ionic surfactants additionally may comprise propylene oxide (PO) units in the molecule. Preferably these PO units constitute up to 25% by weight, preferably up to 20% by weight and still more preferably up to 15% by weight of the overall molecular weight of the non-ionic surfactant.

Surfactants which are ethoxylated mono-hydroxy alkanols or alkylphenols, which additionally comprises polyoxyethylene-polyoxypropylene block copolymer units, may be used. The alcohol or alkylphenol portion of such surfactants constitutes more than 30%, preferably more than 50%, more preferably more than 70% by weight of the overall molecular weight of the non-ionic surfactant.

Another class of suitable non-ionic surfactants includes reverse block copolymers of polyoxyethylene and polyoxypropylene and block copolymers of polyoxyethylene and polyoxypropylene initiated with trimethylolpropane.

Another preferred class of nonionic surfactant can be described by the formula:

$$R^1O[CH_2CH(CH_3)O]_x[CH_2CH_2O]_y[CH_2CH(OH)R^2]$$

where $R^1$ represents a linear or branched chain aliphatic hydrocarbon group with 4-18 carbon atoms or mixtures thereof; $R^2$ represents a linear or branched chain aliphatic hydrocarbon rest with 2-26 carbon atoms or mixtures thereof; x is a value between 0.5 and 1.5; and y is a value of at least 15.

Another group of preferred nonionic surfactants are the end-capped polyoxyalkylated non-ionics of formula:

$$R^1O[CH_2CH(R^3)O]_x[CH_2]_kCH(OH)[CH_2]_jOR^2$$

where $R^1$ and $R^2$ represent linear or branched chain, saturated or unsaturated, aliphatic or aromatic hydrocarbon groups with 1-30 carbon atoms; $R^3$ represents a hydrogen atom or a methyl, ethyl, n-propyl, iso-propyl, n-butyl, 2-butyl or 2-methyl-2-butyl group; x is a value between 1 and 30; and k and j are values between 1 and 12, preferably between 1 and 5.

When the value of x is >2, each $R^3$ in the formula above can be different. $R^1$ and $R^2$ are preferably linear or branched chain, saturated or unsaturated, aliphatic or aromatic hydrocarbon groups with 6-22 carbon atoms, where groups with 8 to 18 carbon atoms are particularly preferred. For the $R^3$ group, H, methyl or ethyl are particularly preferred. Particularly preferred values for x are comprised between 1 and 20, preferably between 6 and 15.

As described above, in case x>2, each $R^3$ in the formula can be different. For instance, when x=3, the group $R^3$ could be chosen to build ethylene oxide (EO; $R^3$=H) or propylene oxide ($R^3$=methyl) units which can be used in every single order for instance (PO)(EO)(EO), (EO)(PO)(EO), (EO)(EO)(PO), (EO)(EO)(EO), (PO)(EO)(PO), (PO)(PO)(EO) and (PO)(PO)(PO). The value 3 for x is only an example, and bigger values can be chosen whereby a higher number of variations of (EO) or (PO) units would arise.

Particularly preferred end-capped polyoxyalkylated alcohols of the above formula are those where k=1 and j=1 originating molecules of simplified formula:

$$R^1O[CH_2CH(R^3)O]_x(CH_2CH(OH)CH_2OR^2$$

The use of mixtures of different nonionic surfactants is suitable in the context of the present invention, for instance, mixtures of alkoxylated alcohols and hydroxy group containing alkoxylated alcohols.

Other suitable surfactants are disclosed in WO 1995/001416, to the contents of which express reference is hereby made.

Preferably, the non-ionic surfactants are present in the compositions of the invention in an amount of from 0.1% wt to 5% wt, more preferably 0.5% wt to 3% wt, such as 0.5 to 3% wt. The total amount of surfactants typically included is in amounts of up to 15% wt, preferably of from 0.5% wt to 10% wt, such as 1% wt to 5% wt. The distinct regions may contain any proportion of the total amount of surfactants as desired.

According to an especially preferred embodiment of the present invention, the detergent compositions comprise one or more anti-corrosion agents, especially when the detergent compositions are for use in automatic dishwashing operations. These anti-corrosion agents may provide benefits against corrosion of glass and/or metal and the term encompasses agents that are intended to prevent or reduce the tarnishing of non-ferrous metals, in particular of silver and copper. In many detergent compositions according to the present invention it may be desirable to include more than one type of anti-corrosion agent to provide protection against corrosion of glass and metals.

It is known to include a source of multivalent ions in detergent compositions, and in particular in automatic dishwashing compositions, for anti-corrosion benefits. For example, multivalent ions and especially zinc, bismuth and/or manganese ions have been included for their ability to inhibit such corrosion. Organic and inorganic redox-active substances which are known as suitable for use as silver/copper corrosion inhibitors are mentioned in WO 1994/026860 and WO 1994/026859. Suitable inorganic redox-active substances are, for example, metal salts and/or metal complexes chosen from the group consisting of zinc, manganese, titanium, zirconium, hafnium, vanadium, cobalt and cerium salts and/or complexes, the metals being in one of the oxidation states II, III, IV, V or VI. Particularly suitable metal salts and/or metal complexes are chosen from the group consisting of $MnSO_4$, Mn(II) citrate, Mn(II) stearate, Mn(II) acetylacetonate, Mn(II) [1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$ and $Ce(NO_3)_3$. Any suitable source of multivalent ions may be used, with the source preferably being chosen from sulphates, carbonates, acetates, gluconates and metal-protein compounds. Zinc salts are specially preferred corrosion inhibitors.

Preferred silver/copper anti-corrosion agents are benzotriazole (BTA) or bis-benzotriazole and substituted derivatives thereof. Other suitable agents are organic and/or inorganic redox-active substances and paraffin oil. Benzotriazole derivatives are those compounds in which the available substitution sites on the aromatic ring are partially or completely substituted. Suitable substituents are linear or branch-chain $C_{1-20}$ alkyl groups and hydroxyl, thio, phenyl or halogen such as fluorine, chlorine, bromine and iodine. A preferred substituted benzotriazole is tolyltriazole.

Therefore, an especially preferred optional ingredient according to the present invention is a source of multivalent ions such as those mentioned in the immediately preceding paragraphs and in particular compounds comprising zinc, bismuth and/or manganese ions and/or benzotriazole, including substituted benzotriazoles. In particular, a source of zinc ions and unsubstituted benzotriazole are preferred as anti-corrosion agents and a mixture of these two ingredients is especially preferred according to the invention.

Any conventional amount of the anti-corrosion agents may be included in the compositions of the invention. However, it is preferred that they are present in an total amount of from 0.01% wt to 5% wt, preferably 0.05% wt to 3% wt, more preferably 0.1 to 2.5% wt, such as 0.2% wt to 2% wt based on the total weight of the composition. If more than one anti-corrosion agent is used, the individual amounts may be within the preceding amounts given but the preferred total amounts still apply.

Polymers intended to improve the cleaning performance of the detergent compositions may also be included therein. For example, sulphonated polymers may be used. Preferred examples include copolymers of $CH_2{=}CR^1{-}CR^2R^3{-}O{-}C_4H_3R^4{-}SO_3X$ wherein $R^1$, $R^2$, $R^3$, $R^4$ are independently 1 to 6 carbon alkyl or hydrogen, and X is hydrogen or alkali with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Other suitable sulfonated monomers for incorporation in sulfonated (co)polymers are 2-acrylamido-2-methyl-1-propanesulphonic acid, 2-methacrylamido-2-methyl-1-propanesulphonic acid, 3-methacrylamido-2-hydroxy-propanesulphonic acid, allysulphonic acid, methallysulphonic acid, 2-hydroxy-3-(2-propenyloxy) propanesulphonic acid, 2-methyl-2-propenen-1-sulphonic acid, styrenesulphonic acid, vinylsulphonic acid, 3-sulphopropyl acrylate, 3-sulphopropylmethacrylate, sulphomethylacrylamide, sulphomethylmethacrylamide and water soluble salts thereof. Suitable sulphonated polymers are also described in U.S. Pat. No. 5,308,532 and in WO 2005/090541.

When a sulfonated polymer is present, it is preferably present in the composition in an amount of at least 0.1 wt %, preferably at least 0.5 wt %, more preferably at least 1 wt %, and most preferably at least 3 wt %, up to 40 wt %, preferably up to 25 wt %, more preferably up to 15 wt %, and most preferably up to 10 wt %. The distinct regions may contain any proportion of the total amount of sulphonated polymer as desired.

The detergent composition according to the invention may also comprise one or more foam control agents. Suitable foam control agents for this purpose are all those conventionally used in this field, such as, for example, silicones and their derivatives and paraffin oil. The foam control agents are preferably present in the composition in amounts of 5% by weight or less of the total weight of the composition. The amount in each distinct region may be chosen as desired.

If any distinct region of the detergent composition is in the form of a shaped body or a tablet, then a conventional amount of a binder material may be included in that region. Any conventional binders may be used, typically in an amount of up to 10% wt, more preferably in an amount of up to 5% wt in that distinct region. Suitable binders include polyethylene glycols.

The detergent compositions of the invention may also comprise minor, conventional amounts of perfumes, preservatives and/or colourants in any one or more of the distinct regions. Thickeners may also be used in paste and gel distinct regions. Any suitable thickeners may be used with gums, polymers and gels being preferred.

Such ingredients are typically present in amounts of up to 2% wt in the region in which they are used.

G) Preparation of the Detergent Compositions

The compositions of the invention may be made by any suitable method depending upon their format. For example, wherein the composition comprises solid or semi-solid zones, these may be made by conventional techniques such as by compression of material, e.g., granular/particulate material, in a mould or by casting or extrusion methods. The regions may be made by producing each region separately and then contacting those regions to produce the final composition, by producing the regions sequentially upon each other, or by producing each region concurrently. Manufacturing methods for detergent compositions are well known in the art and do not require further explanation here.

Examples

The present invention is also described and demonstrated by way of the following examples. However, the use of these and other examples anywhere in the specification is illustrative only and in no way limits the scope and meaning of the invention or of any exemplified term. Likewise, the invention is not limited to any particular preferred embodiments described here. Indeed, many modifications and variations of the invention may be apparent to those skilled in the art upon reading this specification, and such variations can be made without departing from the invention in spirit or in scope. The invention is therefore to be limited only by the terms of the appended claims along with the full scope of equivalents to which those claims are entitled.

| | | Example 1 | | | | |
|---|---|---|---|---|---|---|
| | Formul.: 17.15 | Gel 4.9 | Powder 7.00 | MGDA 2.30 | Cont. 2.80 | Top-film 0.15 |
| Raw Materials | Calc. 100% | 28.57% | 40.82% | 13.41% | 16.33% | 0.87% |
| MGDA powder | 14.571 | 51.000 | | | | |
| MGDA gran | 49.789 | | 89.127 | 100.000 | | |
| Sodium carbonate | | | | | | |
| Sodium percarbonate | | | | | | |
| TAED | | | | | | |
| Nonionic surfactant 1 | 9.243 | 32.350 | | | | |
| Benzotriazole | 0.216 | | 0.530 | | | |
| Antifoam | 0.071 | 0.250 | | | | |
| Polyglykol P41/1200 | 3.457 | 12.100 | | | | |
| Acusol 588D | 0.857 | 3.000 | | | | |
| Acusol 588G | | | | | | |
| Zinc sulfate | 0.245 | | 0.600 | | | |
| Protease | 3.338 | | 8.300 | | | |
| Nonionic surfactant 2 | 0.200 | | 0.490 | | | |
| Perfume | 0.053 | | 0.130 | | | |
| Dye 1 | 0.009 | 0.030 | | | | |
| Propylenglykol | 0.277 | 0.970 | | | | |
| Dye 2 | 0.004 | | 0.010 | | | |
| Amylase | 0.332 | | 0.813 | | | |

-continued

| | | Example 1 | | | | |
|---|---|---|---|---|---|---|
| | Formul.: 17.15 | Gel 4.9 | Powder 7.00 | MGDA 2.30 | Cont. 2.80 | Top-film 0.15 |
| Raw Materials | Calc. 100% | 28.57% | 40.82% | 13.41% | 16.33% | 0.87% |
| PEG6000 | 0.086 | 0.300 | | | | |
| PVOH resin | 16.327 | | | | 100.000 | |
| PVOH film | 0.875 | | | | | 100.000 |
| | 100.000 | 100.000 | 100.000 | 100.000 | 100.000 | 100.000 |

| | | Example 2 | | | | |
|---|---|---|---|---|---|---|
| | Formul.: 17.15 | Gel 4.9 | Powder 6.4 | Perc. 2.90 | Cont. 2.80 | Top-film 0.15 |
| Raw Materials | Calc. 100% | 28.57% | 37.32% | 16.91% | 16.33% | 0.87% |
| MGDA powder | 14.571 | 51.000 | | | | |
| MGDA gran | 27.220 | | 72.941 | | | |
| Sodium carbonate | | | | | | |
| Sodium percarbonate | 16.910 | | | 100.000 | | |
| TAED | 4.553 | | 12.200 | | | |
| Nonionic surfactant 1 | 9.243 | 32.350 | | | | |
| Benzotriazole | 0.216 | | 0.580 | | | |
| Antifoam | 0.071 | 0.250 | | | | |
| Polyglykol P41/1200 | 3.457 | 12.100 | | | | |
| Acusol 588D | 0.857 | 3.000 | | | | |
| Acusol 588G | 1.120 | | 3.000 | | | |
| Zinc sulfate | 0.246 | | 0.660 | | | |
| Protease | 3.396 | | 9.100 | | | |
| Nonionic surfactant 2 | 0.183 | | 0.490 | | | |
| Perfume | 0.049 | | 0.130 | | | |
| Dye 1 | 0.009 | 0.030 | | | | |
| Propylenglykol | 0.277 | 0.970 | | | | |
| Dye 2 | 0.004 | | 0.010 | | | |
| Amylase | 0.332 | | 0.889 | | | |
| PEG6000 | 0.086 | 0.300 | | | | |
| PVOH resin | 16.327 | | | | 100.000 | |
| PVOH film | 0.875 | | | | | 100.000 |
| | 100.000 | 100.000 | 100.000 | 100.000 | 100.000 | 100.000 |

| | Example | |
|---|---|---|
| | 1 Percarbonate free composition (comparative) | 2 Percarbonate comprising composition |
| Protein, dried-on | 6.8 | 7.6 |
| Minced meat | 9.3 ± 0.14 | 8.9 ± 0.14 |
| Egg yolk | 4.7 ± 0.07 | 6.2 ± 0.72 |
| Egg yolk/Milk | 6.3 ± 0.11 | 7.7 ± 0.37 |

It can be seen that surprisingly improved egg removal is obtained for formulations comprised of aminocarboxylate and a protease separated from the percarbonate bleaching compound, than for compositions wherein the percarbonate bleaching compound is not present.

While several possible embodiments are disclosed above, embodiments of the present invention are not so limited. For instance, while several possible detergent compositions, and methods for forming and/or using said dosage element for use in ware washing machines have been disclosed, other suitable materials and combinations of materials, as well as steps in methods of forming and/or using the element, could be selected without departing from the spirit of embodiments of the invention. Such changes are intended to be embraced within the scope of the invention.

The specific configurations, choice of materials, and the size and shape of various elements can be varied according to particular design specifications or constraints requiring a device, system, or method constructed according to the principles of the invention. The specific steps in methods of making and/or using the dosage elements can also be varied as needed. Such changes are intended to be embraced within the scope of the invention. The presently disclosed embodiments, therefore, are considered in all respects to be illustrative and not restrictive. The scope of the invention is indicated by the appended claims, rather than the foregoing description, and all changes that come within the meaning and range of equivalents thereof are intended to be embraced therein.

All patents, applications, publications, test methods, literature, and other materials cited herein are hereby incorporated by reference in their entirety as if physically present in this specification.

What is claimed is:

1. A detergent composition comprising an enzyme, a bleaching compound, and a builder, the detergent composition having three or more distinct regions, wherein at least two distinct regions are a solid and wherein at least one distinct region is a gel or paste, wherein the enzyme is located in a first distinct region and the bleaching compound is located in a second distinct region and wherein the builder comprises an amino acid based compound located in the first distinct region and in a third distinct region, wherein the amino acid based compound comprises methyl-glycine-diacetic acid (MGDA), or salts thereof, wherein the first distinct region is substantially free of bleaching compound, wherein the second distinct region is substantially free of builder, wherein the first distinct region is a solid, the second distinct region is a solid and the third distinct region is a gel or paste, wherein the detergent composition is a unit dose detergent composition, and wherein the first distinct region contacts the second distinct region.

2. The detergent composition according to claim 1, wherein the enzyme comprises a protease.

3. The detergent composition according to claim 1, wherein the bleaching compound is selected from inorganic peroxides or organic peracids and mixtures thereof.

4. The detergent composition according to claim 3, wherein the inorganic peroxide is selected from the group consisting of percarbonates, perborates, persulphates and their salts.

5. The detergent composition according to claim 1, wherein the first distinct region is free of bleaching compound.

6. The detergent composition according to claim 1, wherein the second distinct region comprises 10% wt or less of the total amount of enzyme in the detergent composition.

7. The detergent composition according to claim 6, wherein the second distinct region is substantially free of enzyme.

8. The detergent composition according to claim 6, wherein the second distinct region is free of enzyme.

9. The detergent composition according to claim 1, wherein the detergent composition is an automatic dishwashing composition.

10. The detergent composition according to claim 1, wherein the detergent composition is in the form of a shaped body.

11. A process of cleaning soiled items comprises contacting the soiled items with a detergent composition according to claim 1.

* * * * *